US009205895B2

(12) United States Patent
Mueller

(10) Patent No.: US 9,205,895 B2
(45) Date of Patent: Dec. 8, 2015

(54) SECURING THE PLATFORM ON A WATERCRAFT

(71) Applicant: Peter A. Mueller, Gattikon (CH)

(72) Inventor: Peter A. Mueller, Gattikon (CH)

( * ) Notice: Subject to any disclaimer, the term of this patent is extended or adjusted under 35 U.S.C. 154(b) by 0 days.

(21) Appl. No.: 13/728,597

(22) Filed: Dec. 27, 2012

(65) Prior Publication Data

US 2013/0112132 A1 May 9, 2013

Related U.S. Application Data

(63) Continuation of application No. 12/452,657, filed as application No. PCT/CH2008/000317 on Jul. 16, 2008, now abandoned.

(30) Foreign Application Priority Data

Jul. 16, 2007 (CH) ..... 1141/07

(51) Int. Cl.
*B63B 17/00* (2006.01)
*B63B 27/14* (2006.01)
*B63B 27/16* (2006.01)

(52) U.S. Cl.
CPC ..... *B63B 27/14* (2013.01); *B63B 27/143* (2013.01); *B63B 27/16* (2013.01)

(58) Field of Classification Search
CPC ..... B63B 27/14; B63B 27/16; B63B 27/143
USPC ..... 114/343, 362, 363, 364, 369, 258
See application file for complete search history.

(56) References Cited

U.S. PATENT DOCUMENTS

| | | | | |
|---|---|---|---|---|
| 3,365,643 | A | 1/1968 | Arce | |
| 3,693,026 | A | 9/1972 | Miller | |
| 4,669,414 | A | 6/1987 | Molino | |
| 4,742,795 | A * | 5/1988 | DePrey et al. | 114/362 |
| 5,465,079 | A * | 11/1995 | Bouchard et al. | 340/576 |
| 5,484,311 | A | 1/1996 | Detwiler et al. | |
| 5,647,780 | A | 7/1997 | Hosoi | |
| 5,690,045 | A | 11/1997 | Gauthier | |
| 6,021,733 | A | 2/2000 | Jaramillo, Sr. | |
| 6,327,992 | B1 | 12/2001 | Martin | |
| 7,736,204 | B2 | 6/2010 | Kaji | |
| 2006/0137594 | A1 | 6/2006 | Stepp | |

FOREIGN PATENT DOCUMENTS

| | | | |
|---|---|---|---|
| DE | 196 02 331 | A1 | 7/1997 |
| JP | 2007022284 | A * | 2/2007 |

OTHER PUBLICATIONS

Jan. 14, 2009 International Search Report issued in Application No. PCT/CH2008/00317.
Nov. 10, 2011 Office Action issued in U.S. Appl. No. 12/452,657.
Jun. 27, 2012 Office Action issued in U.S. Appl. No. 12/452,657.

* cited by examiner

*Primary Examiner* — S. Joseph Morano
*Assistant Examiner* — Andrew Polay
(74) *Attorney, Agent, or Firm* — Oliff PLC

(57) ABSTRACT

A securing device for a lowerable platform on a watercraft, wherein a lowering of the platform by way of a technical device that is mounted on the tail of the watercraft is only activated after the height and steering positions of the technical device have been adjusted and secured by sensors.

8 Claims, 2 Drawing Sheets

SECURING THE PLATFORM ON A WATERCRAFT

This is a Continuation Application of application Ser. No. 12/452,657 filed Jan. 13, 2010, which is a National Phase of Application No. PCT/CH2008/000317 filed Jul. 16, 2008 and which the claims benefit of Switzerland Patent Application No. 1141/07 field Jul. 16, 2007. The disclosure of the prior applications are hereby incorporated by reference herein in their entirety.

BACKGROUND

The invention provides a security unit and simplifies the handling of a height-adjustable platform for receiving cargo containers and passengers on a watercraft.

Lowerable platforms, particularly for swimmers, divers and cargo containers are known in the art, as disclosed in patent documents DE 196 02 331, U.S. Pat. No. 6,327,992, U.S. Pat. No. 5,690,045. They allow for lowering persons or cargo containers comfortably into the water or receiving the same on board. Elements that are specific to safety, such as the locking of the platform and remote control thereof, are known and have been disclosed, for example, in U.S. Pat. No. 6,327,992.

SUMMARY

The invention is based on the object of ensuring optimum safety in the operation of a watercraft, which includes a height-variable platform for receiving cargo containers or persons or lowering cargo containers or persons into the water, by providing that certain processes can only occur when certain conditions have been met previously. Similarly, not too many displays are to be provided to avoid confusing the operator; to be provided is only basic information that is able to indicate or automatically go to a certain position. If the platform is to be lowered, wherein a Z-drive is connected thereto in the tail region of the watercraft, the Z-drive must not be in the raised position and the steering angle must be as small as possible such that it is possible to lower the platform without collision. Similarly, with a lowered platform, for example, it is only possible to operate the craft at low speeds or not at all. Furthermore, the platform is not to go beyond the prior set target or be lowered too tightly, such as, for example, relative the receiving of a cargo container, which is achieved in that the platform automatically travels to the correct position by means of a preset starting location.

In addition to a cut-out on the platform, and while simultaneously a cover is being provided for a Z-drive or jet drive or rudder by means of a door having lateral covers or also contactors, whereby upon being touched by a foot or another extremity the platform is immediately brought to a halt, the easy and logical operation of the comfort elements is also a safety feature of the overall system. A remote control that is operable beyond the direct visible range of the platform is problematic in terms of safety engineering, an integrated radio via Bluetooth in the remote control is comfortable and constitutes a direct, recurring handling feature on the operating part, thereby ensuring familiarity and subconsciously memorization of operation by fine motor skills.

The invention envisions incorporating safety-enhancing components on a height-adjustable floating platform, thereby simplifying the operation of the system in that certain sequences can only occur by means of forcibly and previously completed functions, simultaneously improving comfort and thereby relieving any possible functional stresses, which also constitutes a clear safety element.

BRIEF DESCRIPTION OF THE DRAWINGS

Various exemplary aspects will be described with reference to the drawings, wherein.

DETAILED DESCRIPTION OF THE EMBODIMENTS

Figure 1:
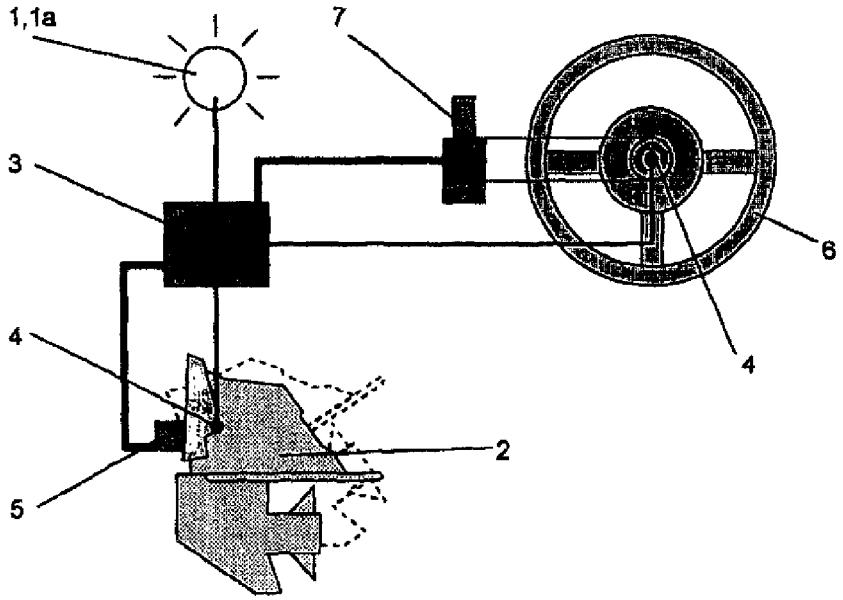
FIG. 1 is a schematic functional view of a simple operation means for a height-adjustable platform having a switch and a control light, a controller, a sensor on the technical means, a steering wheel operative means and a steering wheel.

FIG. 1 shows a schematic functional view of a simple operating means for a height-adjustable platform 17 having a switch 1 and a control light 1*a*, which allows for activating the platform 17 by tapping or shifting a switch. This brings all the necessary systems for the start-up of operation to raise or lower platform 17 and all securing means 24, including the means 1, 1*a*, 3, 4, 5, 7, 8, 9, 10, 11, 12 and 23 in the ready state. A flashing of the control light 1*a*, which is integrated in the switch 1, indicates that the activation of the system has not been successful yet; simultaneously, any steps are initiated to remove any obstacles: collision-inducing technical means 2 such as, for example, rudder, jet drive or, as presently shown, a Z-drive, are automatically raised by operative means 5 and brought into an elevated position, which was previously programmed into the controller 3 via a sensor 4. Also located on the steering wheel 6 is a further sensor 4, which provides information as to the locked steering angle. The operator must now turn the steering wheel until the control light 1*a* is lit continuously, thereby indicating that the system for raising or lowering the platform 17 is in the ready state of operation. Instead of turning the steering wheel by hand, an auxiliary drive 7 can be utilized. Instead of moving the Z-drive automatically in position, the same can also be activated manually by means of a trimming switch. The control light la does not transition from the flash mode to a continuously lit mode until the correct height position and steering wheel position of the Z-drive are reached, at which time the height-adjustable platform 17 is in the ready state for receiving commands. Providing acoustic information as to the adjustment state is also a conceivable option.

Figure 2:
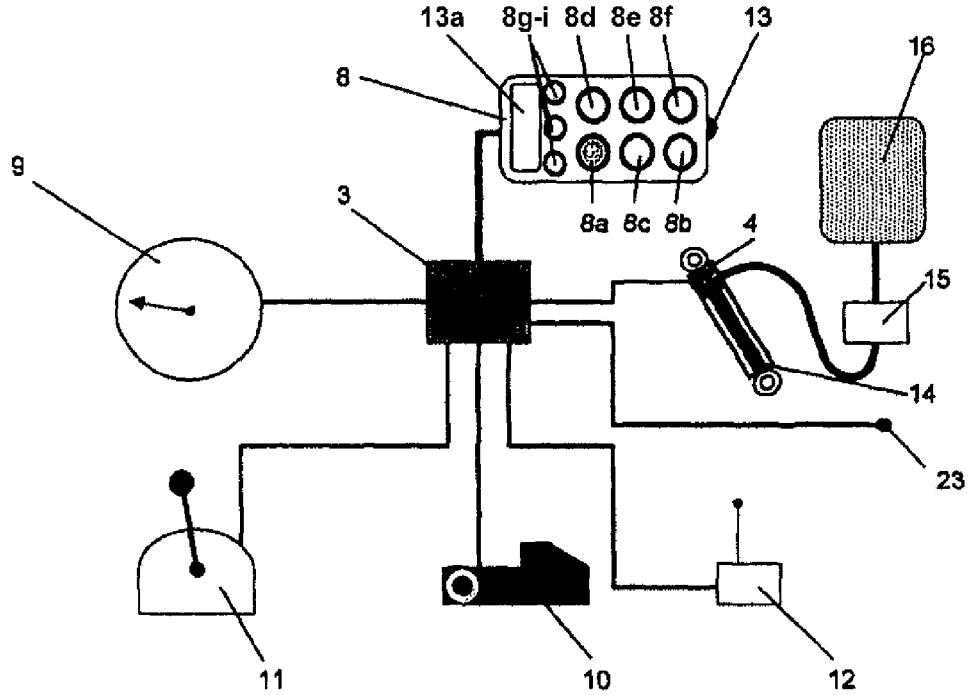
FIG. 2 is a schematic functional view of safety elements for a height-adjustable platform containing a manual control, sensors, engine speed sensor, locking element, transmitter, all of which are connected to a controller and comprising a manually operable pressure relief of the system.

FIG. 2 shows a schematic functional view of safety elements for a height-adjustable platform 17. This includes a water-proof manual control 8, sensors 4, engine speed sensor 9, locking element 10, gear lever position 11, transmitter 12, all of which are connected to a controller 3. The manual control 8 is the interface between man and machine and requires additional attention in terms of size, handling, haptics and time of operation. The manual control 8 must be a familiar element to the user, which is why the user should use this part as often as possible during his or her free time in order to memorize the functionalities associated with each button until use of the control becomes routine. Nevertheless, certain preset processes must occur to ensure that any operational errors are unlikely, in as much as this is possible. To activate the buttons for lowering and raising the platform 17, it is first necessary to press button 8*a*, which is responsible for activating the platform 17. Within a time window, the downward-button 8*b* or upward-button 8*c* must be pressed, wherein the button must be continuously pressed for a corresponding lift action H to occur, otherwise the lift action is stopped.

Using the same process, it is also possible to operate a gangway via button functionalities 8*d*, 8*e*, 8*f*. Furthermore, it is possible to operate the radio 8*g*, telephone 8*h* or even measure the temperature 8*i*, wherein it is advantageous for the temperature sensor 13 to be located at the manual control 8, which is also where the display 13*a* is located, because a temperature sensor underneath the keel heats up during travel and requires a relatively long time to return to a correct display of the environmental temperature; plus, the temperature underneath the keel is not necessarily the same temperature as that which is of interest to the bather who wants to have his or her feet immersed in the water and lowers the platform 17 to a correspondingly limited degree.

Before any command that is entered at the manual control 8 is implemented, such as, for example, in sequence 8*a* then 8*b*, the controller 3 queries the speed 9 and the gear lever position 11, wherein the gear lever position 11 is used to check as to whether the propeller shaft is engaged or disengaged with the marine engine. Depending on the shipyard, it can be decided if travel with a lowered platform 17 is permitted at all and, if so, to what speeds, because the platform 17 generates a resistance under water that is unable to withstand the fastening of the platform 17 at the tail of a watercraft after a certain value has been reached. Similarly, the position of platform 17 is detected by means of a sensor 4, presently shown by way of a cylinder 14, whereby with raised platform 17 it is only possible to raise the platform to a limited degree, but with a lowered platform it can be raised at all times irrespective of the speed 9 or gear lever position 11. Via the controller, corresponding to speed 9, gear lever position 11 and information by sensor 4, the locking element 10 is then opened in order to allow for lowering of the platform 17, wherein the lift system first removes the load, preferably, from the locking element 10 via the cylinder 14, and/or helps to open the same or in fact opens the same. Using the corresponding buttons 8*x*, it is also possible to tap and start a preset, special lift function such as, for example, for the quick and easy raising of a cargo container, or to achieve for the platform 22 quickly and easily a precisely fitted identical lift height for a second platform. If a remote control is provided, the same has a range that is equal to the visual contact with the platform 17, meaning that no control action is possible from the complex bow structure of the watercraft or from inside the cabins.

The hydraulics system 16 applies hydraulics to the lift mechanism 16 and includes a valve control 15 in order to render the system, if necessary, pressureless by manual means such that, should the electrical or hydraulic system fail, the platform 17 can be raised by means of the buoyant body mounted on the platform 17 or the gas pressure spring mounted on the lift system, whereby the platform latches into place automatically on the locking element 10, and whereby the platform 17 remains secured against lowering upon shore leave of the watercraft.

Figure 3:
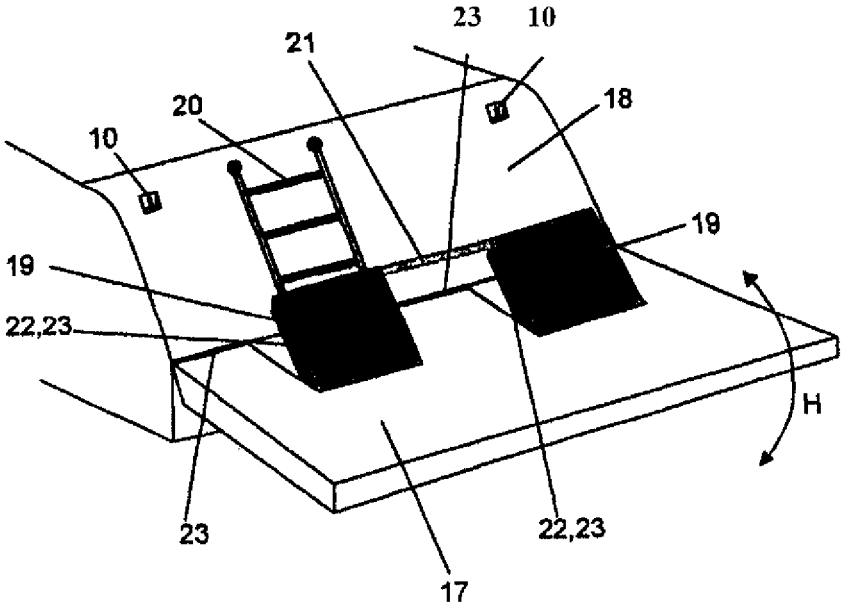
FIG. 3 is a schematic 3D view of a height-adjustable platform arranged in the tail region of a watercraft with forcibly controlled covers, sensor strips and integrated bathing ladder.

FIG. 3 shows a schematic 3D view of a height-adjustable platform 17 on the tail of a watercraft 18 with a forcibly controlled cover 19, presently indicated for a two-engine vehicle, wherein a cover 19 is connected to a telescope-type bathing ladder 20 that is guided below the cover. The bathing ladder 20 is mounted as rotably supported on the tail of the watercraft 18; and as long as the platform 17 is raised and rests on the tail of the watercraft 18, the bathing ladder 20 is not visible from the outside. If the platform 17 can also be extended horizontally or directly lowered according to arrow H, the bathing ladder is extended correspondingly and forces the cover to open while platform 17 is being lowered, thereby avoiding any collision with the technical means. Furthermore, a synchronization means 21 such as, for example, a bar is also connected to the cover 19, whereby it is ensured that, on a two-engine watercraft, the second cover 19 is opened at the right time, without collision and without mounting a second bathing platform 20. On the cover 19, there is laterally disposed, respectively, a flexible cover strip 22 serving as an advance warning means to prevent any jamming of extremities; respectively, the flexible cover strip 22 contains a contact sensor 23 that initiates an immediate halt in response to outside contact. This function of the jam-prevention stop can also be mounted on the side of the platform 17 toward the tail of the watercraft 18. The cover strip 22 can also have a triangular shape, whereby there is no gap relative to the platform 17 even with unfolded cover 19.

It is understood that the invention is not limited to the embodiments as indicated and described above.

What is claimed is:

1. A security unit for a lowerable platform on a watercraft, the security unit comprising:

a platform with a lift mechanism fixed to the platform;

a steering sensor that detects a steering angle of a steering wheel;

an obstacle sensor that detects whether an obstacle associated with the watercraft is at a predetermined elevated position; and a controller that is structured to:

allow the platform to be lowered when both the steering sensor detects that the steering angle of the steering wheel is at a predetermined angle and the obstacle sensor detects that the obstacle is at the predetermined elevated position; and not allow the platform to be lowered when either the steering sensor detects that the steering angle of the steering wheel is not at the predetermined angle or the obstacle sensor detects that the obstacle is not at the predetermined elevated position.

2. The security unit according to claim 1, wherein the obstacle includes a rudder, a jet drive or a Z-drive.

3. The security unit according to claim 1, wherein the obstacle is a Z-drive, and the Z-drive must be in a position other than in a raised position in order for the controller to allow the platform to be lowered.

4. The security unit according to claim 1, further comprising:

a control light, wherein the controller controls the control light such that the control light flashes when the controller does not allow the platform to be lowered and the control light is continuously lit when the controller allows the platform to be lowered.

5. The security unit according to claim 1, wherein the steering angle of the steering wheel is adjusted to the predetermined angle either manually or via an auxiliary drive.

6. The security unit according to claim 1, wherein the controller automatically moves the steering wheel to the predetermined angle and the obstacle to the predetermined elevated position in order to lower the platform.

7. The security unit according to claim 1, wherein whether the controller allows the platform to be lowered is also dependent on an engine speed control or a gear lever position.

8. The security unit according to claim 1, further comprising:

a locking element that is capable of locking the platform in a raised position, wherein the controller unlocks the locking element when the platform is in the raised position in order to lower the platform.

* * * * *